United States Patent [19]

Stahlecker et al.

[11] Patent Number: 4,945,718

[45] Date of Patent: Aug. 7, 1990

[54] AIR NOZZLE FOR PNEUMATIC FALSE-TWIST SPINNING

[75] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[73] Assignees: Fritz Stahlecker; Hans Stahlecker, both of Fed. Rep. of Germany

[21] Appl. No.: 398,446

[22] Filed: Aug. 25, 1989

[30] Foreign Application Priority Data

Aug. 27, 1988 [DE] Fed. Rep. of Germany ..... 3829150

[51] Int. Cl.[5] ..... D01H 1/115; D02G 1/04; D02G 1/16; D02J 1/08

[52] U.S. Cl. ..... 57/333; 28/271; 57/328; 57/350

[58] Field of Search ..... 57/333, 350, 328; 28/271–276

[56] References Cited

U.S. PATENT DOCUMENTS 4,807,431 2/1989 Braxmeier ..... 57/333

FOREIGN PATENT DOCUMENTS 3301652 7/1983 Fed. Rep. of Germany .
3732708 7/1988 Fed. Rep. of Germany .
61-58571 12/1986 Japan .

*Primary Examiner*—John Petrakes
*Attorney, Agent, or Firm*—Evenson, Wands, Edwards, Lenahan & McKeown

[57] ABSTRACT

In the case of an air nozzle for pneumatic false-twist spinning having several parts arranged behind one another in moving direction of the yarn, it is provided that the part which is arranged behind the part containing the compressed-air ducts, in moving direction of the yarn, is made of a harder, more wear-resistant material and has a smaller diameter than the preceding part.

18 Claims, 2 Drawing Sheets

AIR NOZZLE FOR PNEUMATIC FALSE-TWIST SPINNING

BACKGROUND AND SUMMARY OF THE INVENTION

The invention relates to an air nozzle for pneumatic false-twist spinning having several parts arranged behind one another in moving direction of the yarn, each part forming a section of a yarn duct and one of these parts being provided with compressed-air ducts leading into the yarn duct.

In a known air nozzle of the initially mentioned type (DE-A 37 32 708), the comPressed-air ducts are provided between the surfaces, which rest against one another, of two parts following one another. The inside diameters of the parts increase step-by-step in moving direction of the yarn.

In another known air nozzle (DE-A 33 01 652), the compressed-air ducts are worked into a part as round bores. Also in this construction, a part with a larger inside diameter connects to the parts having the mouths of the compressed-air ducts.

On the basis of JP-B 61-58 571, which shows an air nozzle in a very schematic position, it is known to arrange in a central section of the nozzle, which contains the compressed-air ducts, inserts in moving direction of the yarn in front of and behind the compressed-air ducts which have a smaller diameter than the area of the compressed-air ducts.

An object of the invention is to develop the part which contains the compressed-air ducts in such a manner that, if possible, this part is subjected to no wear.

This object is achieved in that, in moving direction of the yarn, behind the part containing the compressed-air ducts, a part is arranged which consists of a material which is harder and more resistant to wear than the preceding part and has a smaller inside diameter than that part.

Since the part with the compressed-air ducts has a larger inside diameter than the part which follows, it is subjected to no or practically no contact with the yarns which are moving through, so that no significant wear occurs, particularly in the area of the mouths of the compressed-air ducts. In addition, the part which follows is wear-resistant so that the overall wear can be reduced. The part having the compressed-air ducts is made of a softer material, so that the mounting of the compressed-air ducts does not become more difficult.

In a further development of certain preferred embodiments of the invention, it is provided that the part which precedes the part containing the compressed-air ducts is made of a harder and more wear-resistant material and has a smaller diameter. By means of this development, it is also ensured that a contact of the part having the compressed-air ducts with the fiber material is largely avoided, while, in addition, the inlet area is also more protected with respect to wear.

In a further development of certain preferred embodiments of the invention, it is provided that the part in front of and/or the part behind the part containing the compressed-air ducts is made of a ceramic material. As a result, a particularly good protection is obtained with respect to wear.

In a further development of certain preferred embodiments of the invention, it is provided that the compressed-air ducts are drilled into the corresponding part with a round cross-section. By means of this drilling of round ducts, high-precision cross-sections are obtained which are advantageous with respect to the flow. In this case, it is advantageous for the compressed-air ducts to be aligned vertically with respect to the moving direction of the yarn. This vertical alignment with respect to the moving direction of the yarn permits a precise drilling which is particularly significant if the compressed-air ducts are arranged as tangentially as possible with respect to the inside diameter.

In a further development of certain preferred embodiments of the invention, it is provided that the parts are joined together with a housing part as a preassembled constructional unit. This ensures that, during the operation of the spinning machine, the air nozzle is not displaced and possibly damaged by improper handling in the area of the compressed-air ducts.

Other objects, advantages and novel features of the present invention will become apparent from the following detailed description of the invention when considered in conjunction with the accompanying drawings.

DETAILED DESCRIPTION OF THE DRAWINGS

Figure 1:
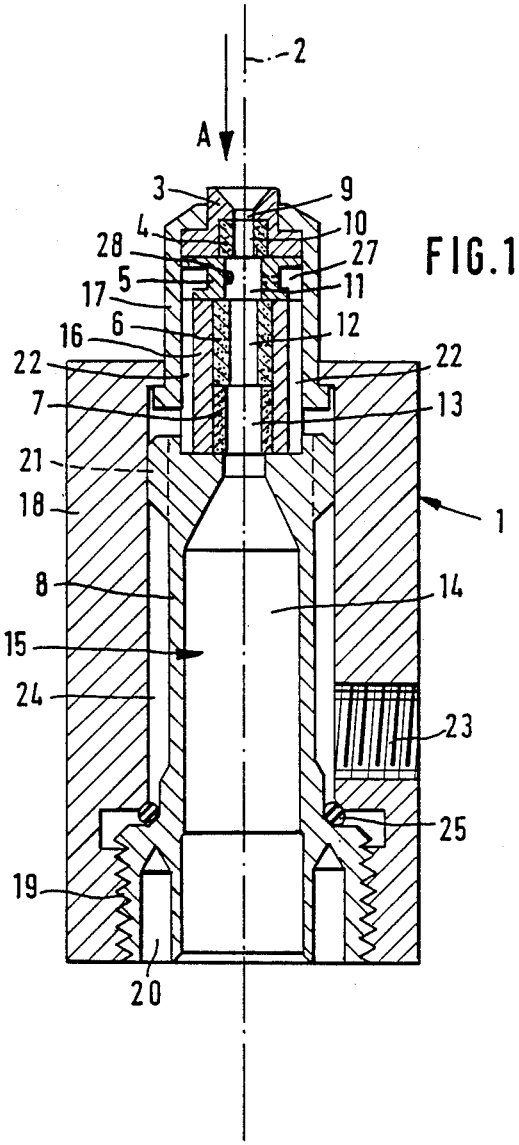
FIG. 1 is an axial sectional view of an air nozzle constructed according to a preferred embodiment of the invention.

The shown air nozzle 1 is used for pneumatic false-twist spinning. It provides a false twist to a sliver 2, which is drawn or drafted to the desired yarn size in a drafting unit, which is not shown, and which enters in yarn moving direction (A). Subsequently, this twist will largely open up again so that only fiber ends remain wound around the essentially untwisted sliver. The air nozzle 1 may be used for the fine-spinning of a yarn. However, preferably it is used for only prestrengthening a sliver 2 which subsequently is wound on a spool package together with another prestrengthened yarn structure as a double yarn, this spool package being used as a feeding package for a subsequent twisting operation. The air nozzle 1, in the conventional way, is followed by a pair of withdrawal rollers which are also not shown.

The air nozzle 1 contains a yarn duct 15 which consists of several sections 9, 10, 11, 12, 13 and 14. These sections 9 to 14 are formed by parts 3, 4, 5, 6, 7 and 8 which are arranged axially behind one another. Part 3 is constructed as an inlet funnel which changes into a cylindrical section 9 of the yarn duct 15. Part 3 is followed by part 4 which is made of a ceramic material and, in the manner of a sleeve, is surrounded by part 3 which serves as a metal enclosure.

Part 4 is followed by part 5 which is equipped with compressed-air ducts 28. This part 5 will be described later by means of FIG. 2 and 3. The inside diameter of section 11 of the yarn duct 15, in the area of part 5, is larger than the inside diameter of part 4. In addition, it is larger than the inside diameter of the part 6 which follows, which is also made of a ceramic material. This part 6, with a shoulder, which with respect to the diameter, represents a widening, changes over into part 7 which is also made of a ceramic material. Parts 6 and 7 are enclosed by a sleeve 16 made of metal which, on its outer circumference, is provided with axially extending grooves 22.

Parts 3, 4, 5, 6 and 7 form a constructional unit with a housing part 17. Part 3 is provided with a surrounding collar by means of which it supports itself in axial direction at a corresponding shoulder of the housing part 17. Part 5, which is made of a metal which is easily workable by means of drilling, has a collar by means of which it is guided in the inside bore of the housing part 17. The sleeve 16 of parts 6 and 7 is pressed into the inside bore of the housing part 17 with a press fit, so that this housing part 17 forms a firmly preassembled constructional unit with the parts 3, 4, 5, 6, 7 contained in it. Parts 3 and 5 may also be guided in the housing part 17 with a press fit or with a sliding fit. In this case, it should be observed that the fitting, particularly between part 3 and the housing part 17, is designed to be such that an airtight closure is provided.

The housing part 17, at its end which faces away from the entry side, is provided with a collar by means of which it is held in axial direction in a housing 18. The outer circumference of the housing part 17 is coordinated with respect to a bore of the housing 18 in such a manner that it is provided with an airtight connection. The constructional unit consisting of the housing part 17 and parts 3, 4, 5, 6, 7, by means of an insert 8, is braced in axial direction into the housing 18 against the already mentioned ring shoulder. For this purpose, the insert 8 supports itself at the sleeve 16, in axial direction by means of a corresponding stop surface. The insert 8 is threaded by means of an external thread into a corresponding internal thread of the housing 18. Insert 8 is provided with several axial bores 20 in order to be able to apply a tool. The insert 8 is provided with a ring shoulder at which a sealing ring 25 is supported, which supports itself with respect to a sealing surface in the interior of the housing 18. A toroidal chamber 24 remains between the housing 18 and the insert 8. This toroidal chamber 24, by way of axial grooves 21 of the insert 8, is open toward the area of the axial grooves 22. The toroidal chamber 24 can be connected to a compressed-air source by means of a compressed-air connection 23 of the housing 18.

Figure 2:
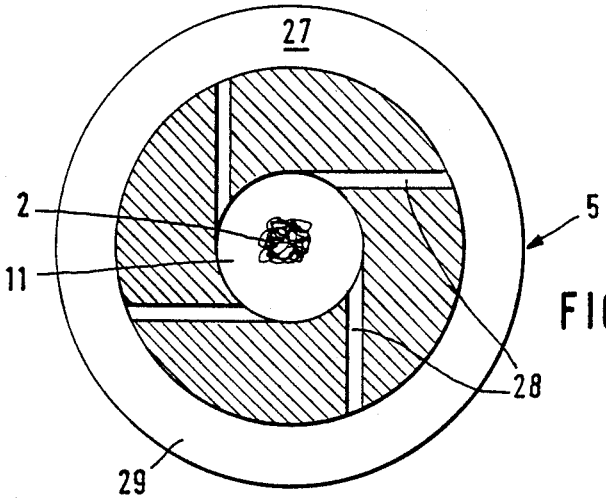
FIG. 2 is an enlarged cross-sectional view of the air nozzle in the area of a part containing the compressed-air ducts.
Figure 3:
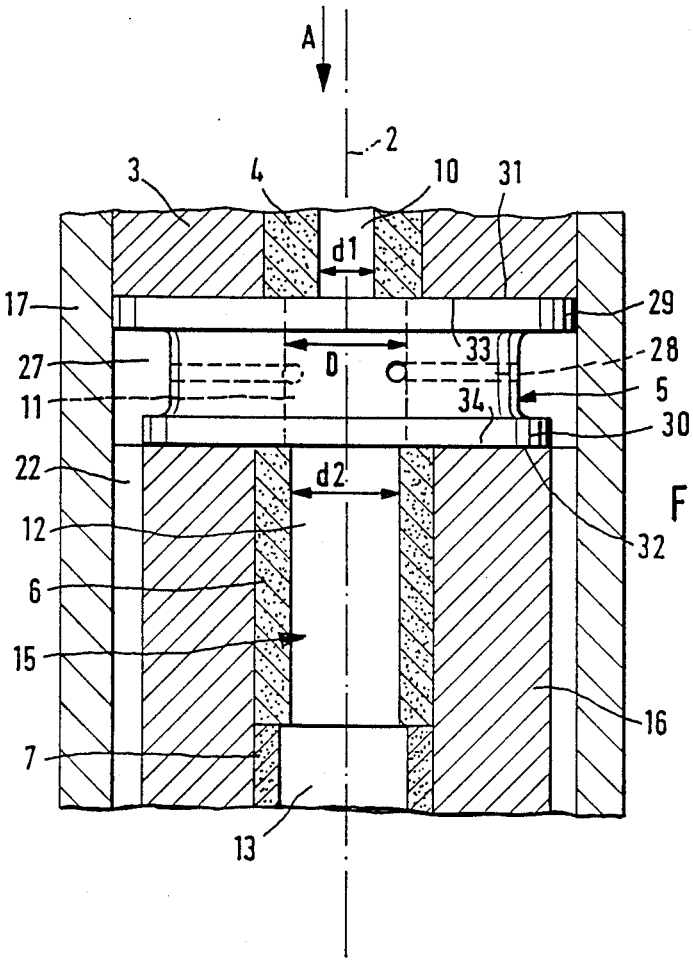
FIG. 3 is an enlarged cutout of an axial sectional view of the air nozzle.

As shown particularly in FIGS. 2 and 3, part 5, which contains the compressed-air ducts 28, has a collar 29 by means of which it is guided on the inside in the housing part 17. On its outer circumference, it is provided with a surrounding ring groove 27 which, in the direction to the other side, is delimited by a collar 30, which has a diameter which corresponds to the diameter of the groove bottom of the axial groove 22 of the sleeve-shaped part 16. The two collars 29, 30 form axial supporting surfaces 33, 34, which are opposed by corresponding axial supporting surfaces 31, 32 of the preceding metallic parts; i.e. of part 3 and sleeve 16.

The compressed-air ducts 28, as straight and round bores which extend tangentially with respect to the inside diameter, are worked into part 5 which consists of an easily workable metal. These compressed-air ducts 28 are located in a plane. The compressed-air ducts 28 are mounted in a plane which extends vertically or perpendicularly with respect to the moving direction of the yarn (A).

As shown clearly in FIG. 3, part 4 has a duct section 10 with a diameter (d1), which is smaller than diameter (D) of section 11 of the yarn duct 15 of part 5. This diameter (D), in turn, is larger than diameter (d2) of the duct section 12, which follows, which is formed by part 6. The diameter (d1) of part 4, which precedes part 5, in turn, is smaller than the diameter (d2) of part 6 which follows it. The drawn and false-twisted sliver is therefore guided in the area of section 11 of the yarn duct 15 of part 5 in such a manner that it does not come in contact with the interior surface of this duct section. It is therefore subjected to practically no wear, so that a relatively soft material may be used which permits a simple and nevertheless precise providing of the bores 28, which have only a very small cross-section of less than 1 mm and usually less than 0.5 mm.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An air nozzle for pneumatic false-twist spinning of a yarn having several nozzle parts arranged behind one another in moving direction of the yarn, each part forming a section of a yarn duct and one of these parts being provided with compressed-air ducts leading into the yarn duct, wherein, in the moving direction of the yarn (A), behind the compressed-air duct nozzle containing the compressed-air ducts, a rear nozzle part is arranged which consists of a material which is harder and more resistant to wear and has a smaller inside diameter (d2) than the compressed-air duct part, and wherein a front nozzle part which immediately precedes the compressed-air duct nozzle part is made of a harder, more wear-resistant material and has a smaller inside diameter (d1) than said compressed-air duct nozzle part.

2. An air nozzle according to claim 1, wherein at least one of the front nozzle part and the rear nozzle part is made of a ceramic material.

3. An air nozzle according to claim 2, wherein the compressed-air ducts are drilled into the corresponding compressed-air duct part with a round cross-section.

4. An air nozzle according to claim 3, wherein the compressed-air ducts are aligned in a plane extending perpendicular with respect to the yarn moving direction (A).

5. An air nozzle according to claim 2, further comprising a sleeve-type metal enclosure for the at least one nozzle parts made of ceramic material.

6. An air nozzle according to claim 2, wherein both the front and rear nozzle parts are made of ceramic material.

7. An air nozzle according to claim 6, wherein the compressed-air ducts are drilled into the corresponding compressed-air duct part with a round cross-section.

8. An air nozzle according to claim 7, wherein the compressed-air ducts are aligned in a plane extending perpendicular with respect to the yarn moving direction (A).

9. An air nozzle according to claim 1, wherein the rear nozzle part is made of a ceramic material.

10. An air nozzle according to claim 1, wherein the compressed-air ducts are drilled into the corresponding compressed-air duct part with a round cross-section.

11. An air nozzle according to claim 10, wherein the compressed-air ducts are aligned in a plane extending perpendicular with respect to the yarn moving direction (A).

12. An air nozzle according to claim 1, further comprising a nozzle housing part, wherein the nozzle parts are joined together with the nozzle housing part to form a preassembled constructional unit.

13. An air nozzle according to claim 12, further comprising a housing, wherein the constructional unit is clamped into the housing.

14. An air nozzle according to claim 12, further comprising a compressed-air supply connection, wherein the compressed-air duct part is provided on its exterior side facing the nozzle housing part with a ring groove which is connection with the compressed-air supply connection by axial grooves at the exterior side of the following rear nozzle part.

15. An air nozzle according to claim 12, wherein the compressed-air ducts are aligned in a plane extending perpendicular with respect to the yarn moving direction (A).

16. An air nozzle according to claim 15, further comprising a housing, wherein the constructional unit is clamped into the housing.

17. An air nozzle according to claim 16, further comprising a compressed-air supply connection, wherein the compressed-air duct part is provided on its exterior side facing the nozzle housing part with a ring groove which is connected with the compressed-air supply connection by axial grooves at the exterior side of the following rear nozzle part.

18. An air nozzle according to claim 17, further comprising a sleeve-type metal enclosure for the at least one nozzle parts made of ceramic material.

* * * * *